US005680992A

United States Patent [19]

Grytz et al.

[11] Patent Number: 5,680,992

[45] Date of Patent: Oct. 28, 1997

[54] FUEL INJECTION VALVE HAVING A TWO-PART ATTACHMENT

[75] Inventors: Uwe Grytz, Bamburg; Stefan Lauter, Lawutertal, both of Germany

[73] Assignee: Robert Bosch GmbH, Stuttgart, Germany

[21] Appl. No.: 436,543

[22] Filed: May 8, 1995

[30] Foreign Application Priority Data

May 6, 1994 [DE] Germany ..... 44 15 992.7

[51] Int. Cl.[6] ..... B05B 7/12; F02M 51/00

[52] U.S. Cl. ..... 239/408; 239/431; 239/434; 239/535.4; 239/596

[58] Field of Search ..... 239/585.1–585.5, 239/407–409, 533.12, 596, 432, 429, 431, 434, 424.5, 416.5

[56] References Cited

U.S. PATENT DOCUMENTS 4,957,241 9/1990 Roger ..... 239/409

4,982,716 1/1991 Takeda et al. ..... 123/531

FOREIGN PATENT DOCUMENTS 41 08 279 9/1991 Germany .

*Primary Examiner*—Lesley D. Morris

*Attorney, Agent, or Firm*—Kenyon & Kenyon

[57] ABSTRACT

A fuel injection valve has an attachment with a two-part design including a main body and an insert. With the attachment, the functions of supplying and metering gas are optimized independently of the functions of sealing off the fuel injection valve with respect to an intake conduit and of securing the attachment onto the fuel injection valve. In addition, the fuel injection valve and attachment provide a modular system which allows a large number of possible variations which can be achieved by simple and inexpensive component changes.

10 Claims, 3 Drawing Sheets

FUEL INJECTION VALVE HAVING A TWO-PART ATTACHMENT

FIELD OF THE INVENTION

The present invention relates to a fuel injection valve, in particular to a fuel injection valve for the injection of a fuel/gas mixture in fuel injection systems of internal combustion engines.

Background Information

U.S. Pat. No. 4,957,241 to Roger (the "Roger patent") describes an electromagnetically actuated valve for the injection of a fuel/gas mixture into a mixture-compressing, applied-ignition internal combustion engine. The valve of the Roger patent includes a spacer plate installed between a nozzle body and a protective cap for influencing the air quantity. The spacer plate between the nozzle body and the protective cap has a central opening into which the downstream pintle end of a valve needle projects. The supply of air to the fuel emerging from a fuel passage is accomplished via air passages and air chambers. In the valve of the Roger patent, the radial supply of air to the pintle of the valve needle is determined by the height of spacing knobs. In the final analysis, however, the quantity and composition of the fuel/air mixture is determined by the size of the axially extending annular gap between the pintle of the valve needle and the circumference of the opening in the spacer plate.

U.S. Pat. No. 4,982,716 to Takeda et al. (the "Takeda patent") describes an adaptor in which air supply passages are formed at the downstream end of an injection valve. An impact surface is provided in the adaptor downstream of a single spray opening, the sprayed fuel jet striking the impact surface and being guided in the form of a film into two spray passages, with air from the air supply passages being directed in a specific manner at the fuel films formed after impact. Metering of the air can be accomplished only by means of the air supply passages and is inevitably determined by their cross sections.

Published German Patent Application No. 41 08 279 describes the arrangement of an attachment downstream of a valve seat. The fuel emerging in the form of a column from a nozzle passes directly into an atomization hole of the attachment where it is struck and conditioned by air flowing out of auxiliary air passages formed in the side walls.

In known injection valves with the supply of gas in an attachment, the integration of the functions of supplying air and metering and of securing the attachment onto the injection valve does not allow optimization of these functions.

SUMMARY OF THE INVENTION

The present invention provides a fuel injection valve which in contrast to known valves has the advantage that the functions of supplying gas and metering are separated from the functions of sealing off the fuel injection valve with respect to an intake conduit and of securing the attachment onto the fuel injection valve, thus ensuring that each function is performed more optimally. The modular design configuration furthermore results in a large number of possible variations which can be achieved in a very simple and economical manner.

It is particularly advantageous to construct the attachment in two parts, namely from a tubular main body and a flat insert which can be pushed into at least one slotted opening in the main body. While the main body is used to seal off the fuel injection valve with respect to an intake conduit and to secure the attachment on the fuel injection valve, the insert is primarily responsible for gas supply and metering.

It is furthermore advantageous to provide in the main body a jet divider which maintains or reinforces twin-jet injection from the fuel injection valve.

In order to ensure a well-defined installation position of the insert in the main body, it is advantageous if the insert has a trapezoidal cross section. By means of the formation of inflow regions and boundary regions of different geometries on the insert, it is very simple to influence and adjust the inflow cross section and hence the gas flow rate to an optimum for given requirements. A large variety of different variants can be achieved in a very simple manner in as much as only the inserts need be replaced for different specific applications, while the main body is capable of multiple uses. The system of the present invention is thus modular.

Further advantages are obtained with the valve of the present invention by the use of "tailor-made" plastics for the different components. The use of a polyamide not reinforced with glass fibers for the main body and of a very accurately moldable, highly reinforced plastic such as polyphenylene sulfide for the insert is particularly advantageous.

DETAILED DESCRIPTION OF THE DRAWINGS

Figure 1:
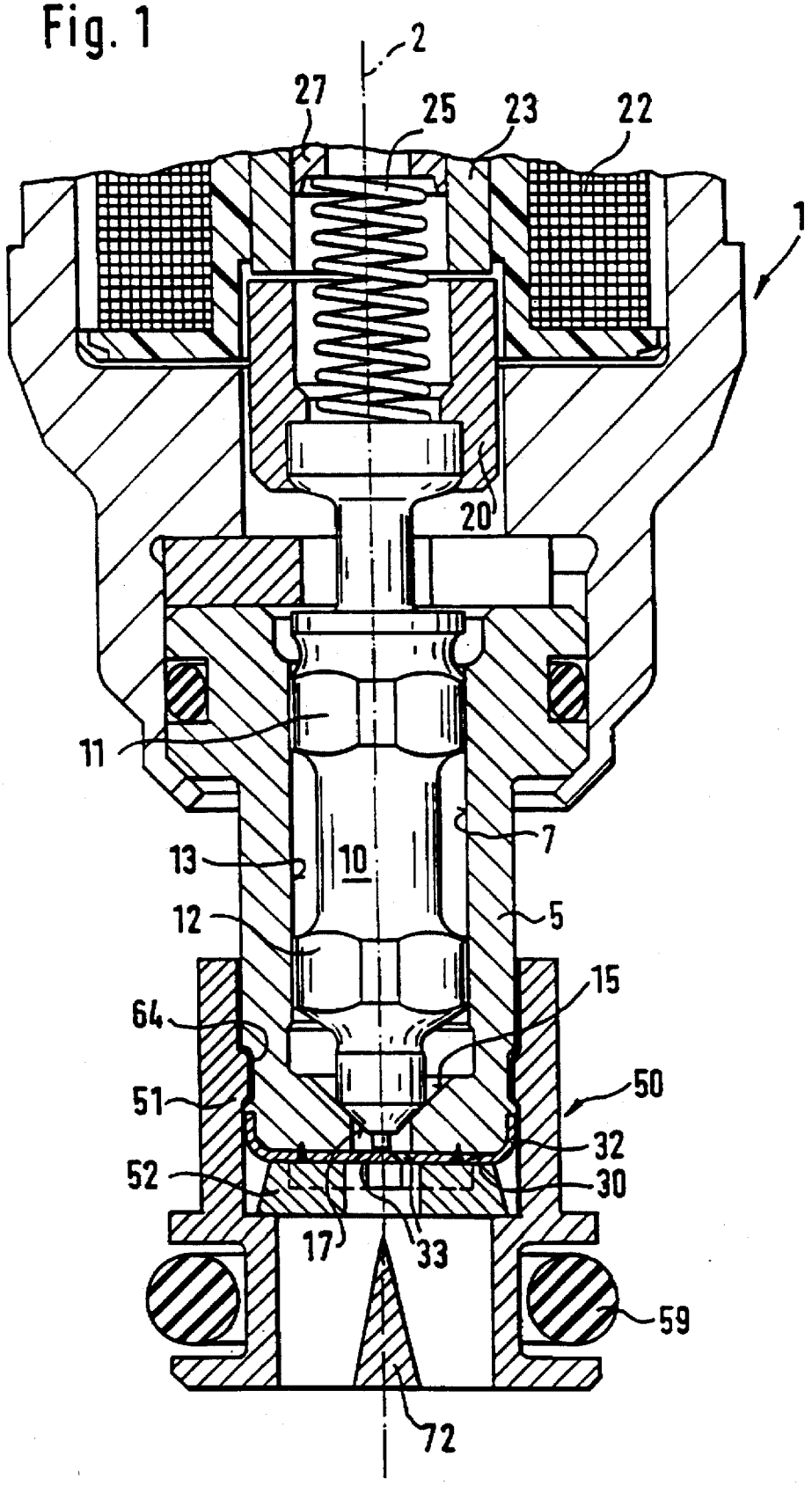
FIG. 1 shows a fuel injection valve depicted in part.

FIG. 1 shows a partial view of a first exemplary embodiment of a fuel injection valve 1, in accordance with the present invention, for use in fuel injection systems of mixture-compressing, applied-ignition internal combustion engines. In FIG. 1, the valve 1 is shown together with an attachment for the injection of a fuel/gas mixture into an intake pipe or directly into the combustion space of the internal combustion engine.

The fuel injection valve 1, which is, for example, electromagnetically actuated, extends cylindrically along a valve longitudinal axis 2. As part of a valve housing, the fuel injection valve 1 has a nozzle body 5 extending at its downstream end. Formed in the nozzle body 5 is a stepped longitudinal hole 7 which extends along the valve longitudinal axis 2 and in which a valve closing part 10, which is, for example, needle-shaped, is arranged. The valve closing part 10 has, for example, two guiding sections 11 and 12 which, together with a guiding area 13 of the wall of the longitudinal hole 7 in the nozzle body 5, serve to guide the valve closing part 10. At its downstream end, the longitudinal hole 7 in the nozzle body 5 has a fixed valve seat 15 which tapers frustoconically in the direction of fuel flow and, together with a sealing section 17 of the valve closing part 10 forms a seat valve.

At the end of the valve closing part 10 remote from the sealing section 17, the valve closing part 10 is connected to a tubular armature 20 which interacts with a magnet coil 22 partially surrounding the armature 20 in the axial direction and with a tubular core 23 of the fuel injection valve 1. The core 23 lies opposite the armature 20 in the direction away from the fixed valve seat 15. A first end of a return spring 25 abuts against that end of the valve closing part 10 which is connected to the armature 20 while a second end of the spring 25 abuts against an adjusting sleeve 27, which is, for example, nonmagnetic. The spring 25 acts to bias the valve closing part 10 in the direction of the fixed valve seat 15.

A perforated spray disk 32, which is connected firmly to the nozzle body 5 such as by a weld produced by means of laser welding, rests against an end 30 of the nozzle body 5 facing away from the core 23. The perforated spray disk 32 has, for example, four spray openings 33, through which fuel, which flows past the valve seat 15 when the valve closing part 10 is raised, is sprayed.

To supply and meter a gas which serves for improved conditioning and atomization of the fuel, an attachment 50, which is made, for example, of plastic, is provided at the downstream end of the fuel injection valve 1. The gas which is metered by the attachment can come from several sources such as the intake air diverted through a bypass which is upstream of a throttle valve in an intake pipe of the internal combustion engine, the air delivered by an additional blower, recirculated exhaust gas from the internal combustion engine, or a mixture of air and exhaust gas. The use of recirculated exhaust gas allows a reduction in the pollutant emissions of the internal combustion engine. The supply of the gas as far as the attachment 50 is not shown specifically in FIG. 1.

The attachment 50 is of a two-part design, comprising a tubular main body 51 radially surrounding the downstream end of the nozzle body 5 and being secured on the latter by being latched in, for example. The main body 51 also extends in the axial direction downstream of the perforated spray disk 32. A flat insert 52 that can be pushed into the main body 51 is, when installed, arranged directly downstream of the perforated spray disk 32. The insert 52 is designed so that a gas can flow from outside the attachment 50 into the interior of the attachment 50 directly downstream of the perforated spray disk 32. In addition to supplying the gas, the insert 52 also performs the function of metering the gas flow rate through the free cross section of flow which is formed. The cross section of flow for the gas in the insert 52 tapers from the outer circumference toward the valve longitudinal axis 2, with the result that the gas is greatly accelerated and the fuel emerging from the spray openings 33 and flowing axially through the insert 52 is hit by the gas at right angles, thereby particularly finely atomizing the fuel.

Figure 2:
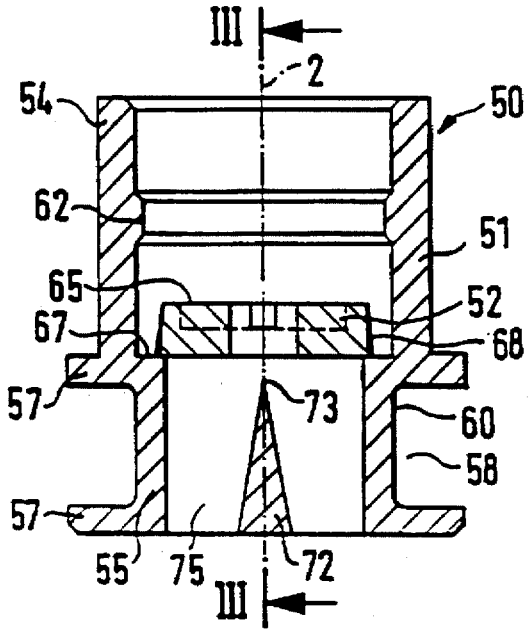
FIG. 2 shows an attachment in accordance with the present invention.

FIG. 2 is a cross-sectional view of the attachment 50 shown apart from the injection valve, as an independent component. The attachment 50 is formed by two individual parts, namely by the tubular main body 51 and by the flat, disk-shaped insert 52, which can be pushed into the main body 51. The main body 51 comprises an upstream carrier section 54 and a downstream jet-dividing section 55. While the carrier section 54 has a completely cylindrical shape with a constant outside diameter, the jet-dividing section 55 has three annular regions of different outside diameters which extend concentrically to the valve longitudinal axis 2 and follow one another axially. Two annular regions 57, which project radially to the same extent beyond the carrier section 54, serve to form an annular groove 58 into which a sealing ring 59 can be inserted. The sealing ring 59 provides a seal between the circumference of the injection valve and a valve holder (not shown), for example, the intake conduit of the internal combustion engine. The annular groove 58 is bounded axially by the two annular regions 57 and radially by a groove base 60, which has a smaller diameter than the outside diameter of the carrier section 54 but is, for example, the same size as the inner diameter of the tubular carrier section 54.

The entire main body 51 of the attachment 50 is secured on the injection valve, specifically on the nozzle body 5, so that there is no risk that the connection will be undone by vibrations or temperature effects. The body 51 is secured to the injection valve by the latching-in of a bead 62 within an encircling groove 64 on the nozzle body 5. The bead 62 which has a small height is formed around the periphery of the carrier section 54 and extends radially in the direction of the valve longitudinal axis 2 from the inner wall of the body 51. By a suitable choice of bead 62 and groove 64, it is also possible to ensure complete security against rotation. The security against rotation is achieved by means, for example, of interengaging and interacting depressions and raised portions on the bead 62 and in the groove 64.

Other methods of connecting the attachment 50 to the nozzle body 5 instead of latching-in or snapping-in are conceivable, such as, for example, by bonding or shrink-fitting, but such methods produce permanent connections. It is also possible to secure the attachment 50 against rotation on the nozzle body 5 by means of knurling or faces in the groove base of the groove 64.

In two regions of its circumference which are offset by 180°, and hence lie exactly opposite one another, the carrier section 54 has slotted openings 65 of trapezoidal cross section through which the flat insert 52 is inserted. The slotted openings 65 are formed in precisely such a way in the downstream end of the carrier section 54 that, as the insert 52 is pushed in, it is moved along on a shoulder 67 which progresses radially inward from the upper annular region 57 and, when viewed in the axial direction lies exactly in the plane of the transition from the carrier section 54 to the jet-dividing section 55. When inserted, the bottom surface of the insert 52 rests on the shoulder 67.

Like the slotted openings 65, the insert 52 also has a trapezoidal cross section with two flat side faces 68 in order to guarantee a defined installation position. The insert 52 can be pushed into the main body 51 in an identical manner starting from either of the two slotted openings 65. In addition to the two flat side faces 68 which form the trapezoidal cross section of the insert 52, two rounded side faces 69 are provided on the insert 52, completing the external shape of the insert 52 between the flat side faces 68. These rounded side faces 69 are designed in such a way that they have the same radius as the main body 51 and thus are flush with and close off the outside of the main body 51 when the insert 52 is fully inserted. The shape of the insert 52 can be seen in FIGS. 4 to 6.

If, for example, it is desired to achieve or maintain twin jets from the fuel injection valve 1 for the purpose of injecting fuel in the direction of two inlet valves, it is expedient to provide a jet divider 72 in the jet-dividing section 55 of the main body 51. The jet divider 72 can have the widest possible variety of configurations that can be selected as a function of the desired jet angles and patterns. In FIGS. 1 and 2, the jet divider 72 is shown, byway of example, with a pointed cutting edge 73 which points toward the perforated spray disk 32, while, starting from the cutting edge 73, the jet divider 72 becomes wider in cross section in the downstream direction, with the result that it has a triangular cross section. The twin-jet spray which is produced by the spray openings 33 of the perforated spray disk 32, but which can be impaired by the intervening supply of gas, is thus maintained or reinforced by the jet divider 72.

Figure 3:
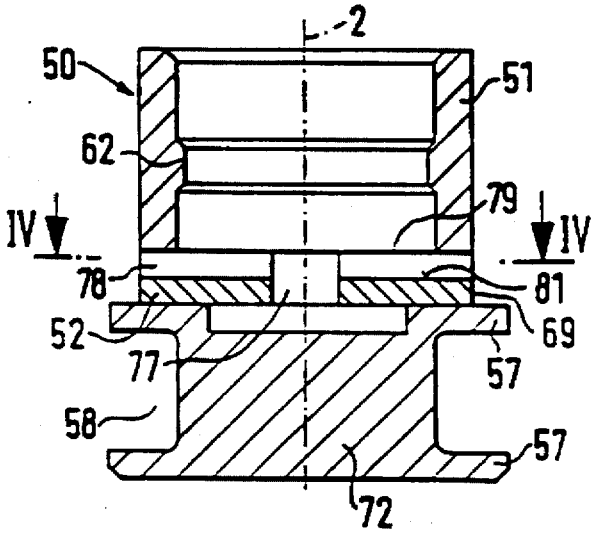
FIG. 3 shows a section along the line III—III in FIG. 2.

The valve longitudinal axis 2 runs precisely through the center of the jet divider 72. The jet divider 72 is of integral construction with the main body 51 and extends from a circumferential region of the jet-dividing section 55 to a circumferential region 180° opposite, as shown in FIG. 3. If symmetrical jet division is required, the jet divider 72 is configured to divide an inner, circular spraying space 75 of the jet-dividing section 55 into two sub-spaces of equal size. The radial direction of extension of the jet divider 72 is, for example, identical with the direction of insertion of the insert 52. It is, of course, also possible to dispense with a jet divider 72 in the main body 51 if multiple fuel jets are not necessary.

FIG. 3 shows a section along the line III—III in FIG. 2, the attachment 50 thus shown rotated 90° relative to its orientation in FIG. 2. This view makes clear that the jet divider 72 divides the spraying space 75 completely and is of integral construction with the main body 51. It can furthermore be seen that the insert 52 has regions which extend to different extents in the axial direction. Two tapering inflow regions 78, which have a smaller axial extent than boundary regions 79 extending from the flat side faces 68 to the opening 77, extend from the rounded side faces 69 toward a central, circular opening 77. With the attachment 50 installed on the fuel injection valve 1, the inflow regions 78 form completely surrounded passages for the supply of gas, these passages being bounded laterally by flanks 80 of the boundary regions 79 and axially by an inflow base 81 and by the carrier section 54 and the perforated spray disk 32. It is furthermore possible to provide in the insert 52 inflow passages which are already completely surrounded in place of the initially open inflow regions 78.

Figure 4:
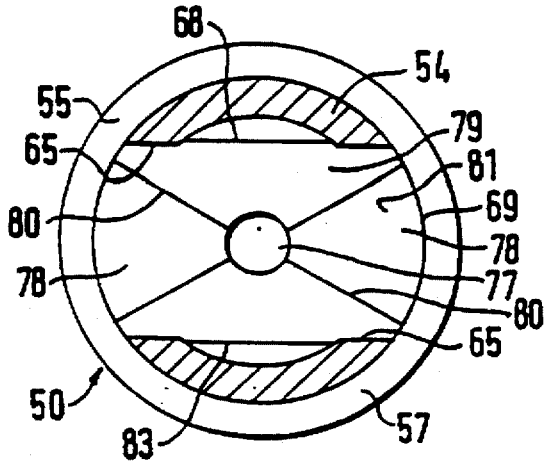
FIG. 4 shows a section along the line IV—IV in FIG. 3 in accordance with a first exemplary embodiment of the present invention.
Figure 5:
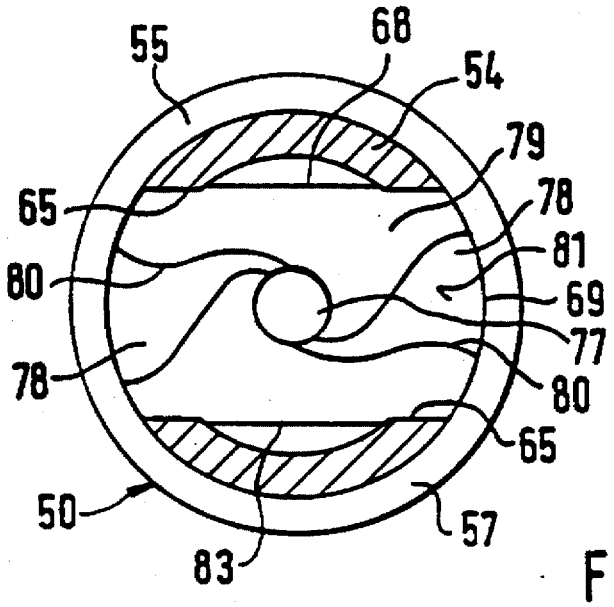
FIG. 5 shows a section through an attachment in accordance with a second exemplary embodiment of the present invention.
Figure 6:
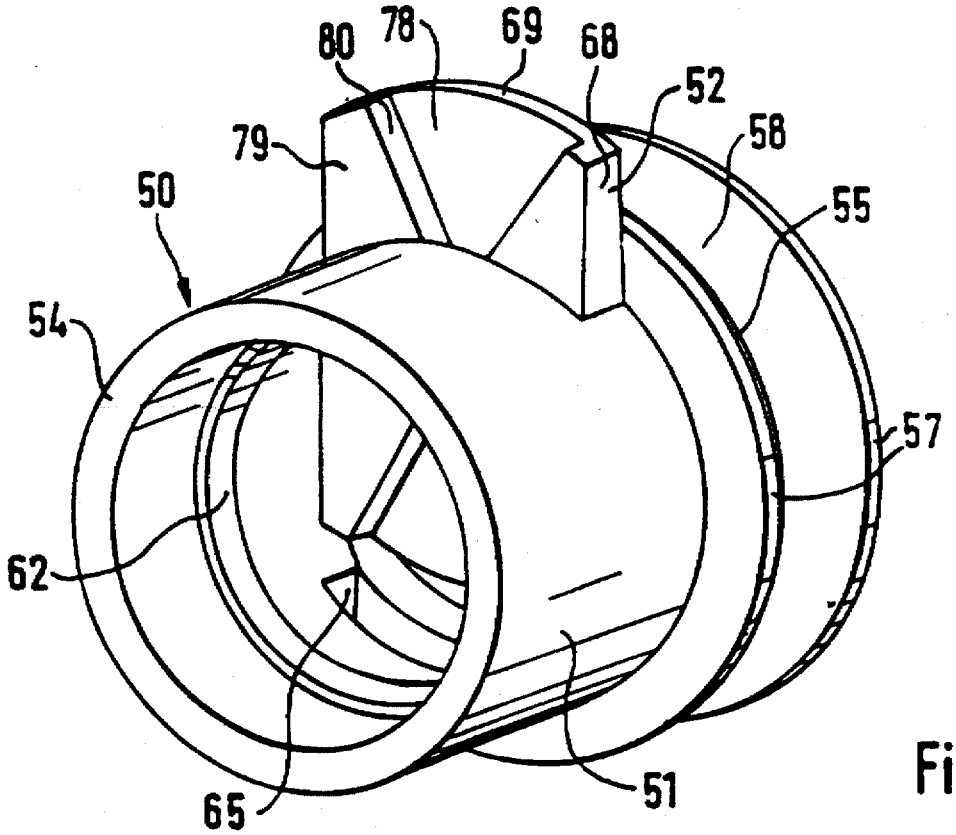
FIG. 6 shows a perspective representation of the attachment of FIG. 5.

The geometry of the inflow regions 78 and the boundary regions 79 with their flanks 80 is made particularly clear by FIGS. 4 to 6. In FIG. 4, which is a representation of a section along the line IV—IV in FIG. 3, the inflow regions 78 are of substantially triangular design and the already described external shape of the insert 52 thus makes the boundary regions 79 largely triangular in shape as well. The two inflow regions 78, which are of symmetrical configuration with respect to one another, have their maximum inflow cross section directly at the rounded side faces 69 to ensure that the gas supplied can flow easily into the insert 52. The width of the inflow region 78 at the rounded side face 69 is slightly less than the width of the overall insert 52. Toward the central opening 77 through which the fuel/gas mixture emerges, the straight flanks 80 of the boundary regions 79 run toward one another with the result that the inflow cross section of the inflow regions 78 becomes increasingly smaller and the speed of the gas increasingly higher.

To secure the insert 52 against sliding in the main body 51, the flat side faces 68 extending obliquely to the valve longitudinal axis 2 are configured in such a way that there is a very small projection 83 in their central region. This projection 83 is, for example, 0.1 mm relative to the side faces 68 with the latter installed in the slotted openings 65 in the carrier section 54. As the insert 52 is pushed in through the slotted opening 65, a relatively narrow region thus enters first, followed by a region of the insert 52 made somewhat wider by the projections 83, which region can be pushed through the slotted opening 65 only by overcoming a resistance and causing a slight deformation of the main body 51. The slightly wider region is then followed by another relatively narrow region. When installed, the region made wider by the projections 83 is thus situated in the interior of the carrier section 54 with the insert 52 thus latched and centered. The insert 52 can now only be removed with the exertion of force.

In another exemplary embodiment in accordance with the present invention shown in FIG. 5, the inflow regions 78 and the boundary regions 79 differ from those in the exemplary embodiment depicted in FIG. 4. To generate a swirl in the gas, which flows in a substantially tangential direction into the opening 77, the flanks 80 of the boundary regions 79 are of spiral configuration. Here too, the inflow region 78 tapers from a large cross section on the rounded side faces 69 toward a very small cross section directly at the opening 77. The swirling gas is thus greatly accelerated and impinges in the opening 77 on the fuel coming from the perforated spray disk 32, with the result that there is a rotational component in the fuel/gas mixture as well.

FIG. 6 shows a perspective representation of the exemplary embodiment of the attachment 50 which has already been illustrated by sectional representations in FIGS. 2 to 4.

By means of the attachment 50, an advantageous separation of the functions of supplying gas, metering and apportioning from the functions of sealing off the fuel injection valve 1 with respect to an intake conduit and of the securing of the attachment 50 on the fuel injection valve 1 is achieved. With the attachment 50 described, it is furthermore possible to achieve a large degree of variety in a simple and economical manner since only the inserts 52 are replaced for specific applications, while the main body 51 can continue to be used, thus yielding a modular system. In addition to the variants for the formation of the inflow region 78, the gas flow rate can also be calibrated by changing the diameter of the opening 77 in the insert 52.

A further factor is an optimum choice of materials. The use of "tailor-made" plastics for the corresponding functions brings further advantages. Thus, for example, the main body 51 is manufactured from a polyamide which is not reinforced with glass fibers and which has a sufficient extensibility. The insert 52, on the other hand, is produced, for example, from a thermally stable, highly reinforced plastic which can be molded with great accuracy, such as polyphenylene sulfide. Such a combination of materials proves advantageous particularly for pushing the insert 52 into the main body 51. Other inflow geometries in the insert 52 are conceivable in addition to the exemplary embodiments already described.

What is claimed is:

1. A fuel injection valve, comprising:

a movable valve closing body, a nozzle body which has a valve seat interacting with the valve closing body, with at least one spray opening downstream of the valve seat; and an attachment arranged on a downstream end of the injection valve downstream of the at least one spray opening and from which a fuel/gas mixture emerges, the attachment including:

means for supplying a gas, an axially extending tubular main body with at least one slotted opening, and a flat insert inserted into the main body through the at least one slotted opening approximately transversely to a valve longitudinal axis, the flat insert including at least one inflow region for the gas, the inflow region leading to an opening.

2. The fuel injection valve according to claim 1, wherein the main body and the insert are made from a plastic.

3. The fuel injection valve according to claim 2, wherein the main body is made from an unreinforced polyamide and the insert is made from polyphenylene sulfide.

4. The fuel injection valve according to claim 1, wherein the at least one slotted opening in the main body of the attachment has a trapezoidal cross section.

5. The fuel injection valve according to claim 1, wherein a jet divider which is integral with the main body is arranged downstream of the insert.

6. The fuel injection valve according to claim 1, wherein the insert has a trapezoidal cross section, flat, side faces and rounded side faces.

7. The fuel injection valve according to claim 1, wherein the insert has boundary regions which at least partially delimit the at least one inflow region and which have a different extent in a direction of the valve longitudinal axis than the at least one inflow region.

8. The fuel injection valve according to claim 1, wherein the at least one inflow region has a triangular configuration and tapers radially toward the valve longitudinal axis.

9. The fuel injection valve according to claim 1, wherein the at least one inflow region has a spiral configuration and tapers radially toward the valve longitudinal axis.

10. The fuel injection valve according to claim 1, wherein the insert is fixed by latching in the main body.

* * * * *